US011624371B2

(12) United States Patent
Chen et al.

(10) Patent No.: US 11,624,371 B2
(45) Date of Patent: Apr. 11, 2023

(54) HIDDEN FAN AND FAN LAMP

(71) Applicant: OPPLE LIGHTING CO., LTD., Shanghai (CN)

(72) Inventors: Zhanhua Chen, Shanghai (CN); Guobao Zhang, Shanghai (CN); Guolong Ni, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 302 days.

(21) Appl. No.: 17/138,896

(22) Filed: Dec. 31, 2020

(65) Prior Publication Data

US 2021/0115938 A1 Apr. 22, 2021

Related U.S. Application Data

(63) Continuation of application No. PCT/CN2019/107369, filed on Sep. 23, 2019.

(30) Foreign Application Priority Data

Sep. 27, 2018 (CN) ..... 201811133067.7
Sep. 27, 2018 (CN) ..... 201821587547.6

(51) Int. Cl.
*F04D 25/08* (2006.01)
*F04D 29/36* (2006.01)
*F21V 33/00* (2006.01)

(52) U.S. Cl.
CPC ..... *F04D 29/362* (2013.01); *F04D 25/088* (2013.01); *F21V 33/0096* (2013.01)

(58) Field of Classification Search
CPC ... F04D 29/362; F04D 25/088; F21V 33/0096
See application file for complete search history.

(56) References Cited

U.S. PATENT DOCUMENTS

2010/0202882 A1 8/2010 Liu
2012/0045331 A1* 2/2012 Villella ..... F04D 29/36 416/5

(Continued)

FOREIGN PATENT DOCUMENTS

CN 205858746 U 1/2017
CN 106979165 A 7/2017

(Continued)

OTHER PUBLICATIONS

International Search Report (including English translation) issued in PCT/CN2019/107369, dated Dec. 19, 2019, 10 pages.

*Primary Examiner* — Sabbir Hasan
(74) *Attorney, Agent, or Firm* — Arch & Lake LLP

(57) ABSTRACT

A hidden fan and a fan lamp are disclosed. The hidden fan includes a turntable assembly and a plurality of fan blade assemblies arranged at the turntable assembly, the turntable assembly has a turntable and a limit wheel configured to rotate relative to the turntable, the turntable has a plurality of fan blade fixing portions, and the plurality of fan blade fixing portions are annularly arranged around a center of the turntable, at least one of the fan blade assemblies has a fan blade and a return elastic component, the fan blade has a fixed portion and a linkage portion arranged at a side of the fixed portion, the fixed portion is arranged at the corresponding fan blade fixing portion, the linkage portion is connected with the limit wheel.

18 Claims, 5 Drawing Sheets

(56) References Cited

U.S. PATENT DOCUMENTS

| | | | | |
|---|---|---|---|---|
| 2018/0258946 | A1* | 9/2018 | Zhou | F04D 29/362 |
| 2019/0120247 | A1* | 4/2019 | Conley | F04D 29/364 |

FOREIGN PATENT DOCUMENTS

| | | | | |
|---|---|---|---|---|
| CN | 108302056 | A | * | 7/2018 |
| CN | 108302056 | A | | 7/2018 |
| CN | 207847973 | U | | 9/2018 |
| CN | 109114038 | A | | 1/2019 |
| CN | 208966693 | U | | 6/2019 |

* cited by examiner

HIDDEN FAN AND FAN LAMP

CROSS-REFERENCE TO RELATED APPLICATIONS

This application is based upon and claims the priority of PCT patent application No. PCT/CN2019/107369 filed on Sep. 23, 2019 which claims priority to the Chinese patent application No. 2018111330677 filed on Sep. 27, 2018 and the Chinese patent application No. 2018215875476 filed on Sep. 27, 2018, the entire content of all of which is hereby incorporated by reference herein for all purposes.

TECHNICAL FIELD

The present disclosure relates to the field of illumination, and more particularly, relates to a hidden fan and a fan lamp.

BACKGROUND

When a hidden fan rotates, fan blades can unfold automatically and drive air to flow. When the hidden fan does not rotate, the fan blades can fold automatically. The hidden fan has a plurality of fan blades. The plurality of fan blades are required to move synchronously. In the prior art, coordination of a sun wheel and a planet wheel is generally adopted for synchronous driving the fan blades, or a link mechanism is adopted for driving the fan blades, so that the structure of the hidden fan is relatively complicated, and a large number of parts are used, which easily increases the load on a turntable, resulting in the decrease of the energy efficiency of the hidden fan, and meanwhile, the overall cost is increased. Moreover, because of a large number of parts, the hidden fan is not easy to assemble, and the assembling precision may be poor.

SUMMARY

The present disclosure provides a hidden fan and a fan lamp.

According to a first aspect, the present disclosure provides a hidden fan. The hidden fan may include a turntable assembly and a plurality of fan blade assemblies arranged at the turntable assembly, the turntable assembly has a turntable and a limit wheel configured to rotate relative to the turntable, the turntable has a plurality of fan blade fixing portions, and the plurality of fan blade fixing portions are annularly arranged around a center of the turntable, at least one of the fan blade assemblies has a fan blade and a return elastic component, the fan blade has a fixed portion and a linkage portion arranged at a side of the fixed portion, the fixed portion is arranged at the corresponding fan blade fixing portion, the linkage portion is connected with the limit wheel, the return elastic component is arranged between the fixed portion and the fan blade fixing portion, and two ends of the return elastic component are respectively connected with the fixed portion and the fan blade fixing portion.

According to a second aspect, the present disclosure provides a fan lamp. The fan lamp may include the hidden fan. The hidden fan may include a turntable assembly and a plurality of fan blade assemblies arranged at the turntable assembly, the turntable assembly has a turntable and a limit wheel configured to rotate relative to the turntable, the turntable has a plurality of fan blade fixing portions, and the plurality of fan blade fixing portions are annularly arranged around a center of the turntable, at least one of the fan blade assemblies has a fan blade and a return elastic component, the fan blade has a fixed portion and a linkage portion arranged at a side of the fixed portion, the fixed portion is arranged at the corresponding fan blade fixing portion, the linkage portion is connected with the limit wheel, the return elastic component is arranged between the fixed portion and the fan blade fixing portion, and two ends of the return elastic component are respectively connected with the fixed portion and the fan blade fixing portion. The hidden fan may include a fan disc and the turntable assembly is arranged on the fan disc. The fan lamp may include a drive motor, a mounting assembly and a lamp, the drive motor is connected with the fan disc and the turntable, an end of the mounting assembly is covered on the drive motor, and the lamp is arranged on the fan disc and is opposite to the hidden fan.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Reference will now be made in detail to examples, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the disclosure. Instead, they are merely examples of apparatuses and methods consistent with aspects related to the disclosure as recited in the appended claims.

The terminology used in the present disclosure is for the purpose of describing particular examples only and is not intended to limit the present disclosure. As used in the present disclosure and the appended claims, the singular forms "a," "an," and "the" are intended to include the plural forms as well, unless the context clearly indicates otherwise. It shall also be understood that the term "and/or" used herein is intended to signify and include any or all possible combinations of one or more of the associated listed items.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to a judgment" depending on the context.

The present disclosure provides a hidden fan and a fan lamp to improve energy efficiency of the hidden fan is decreased, the overall cost is increased, the assembling of the hidden fan is difficult and the assembling precision is poor because of the increase of load on a turntable caused by excessive number of parts.

Figure 1:
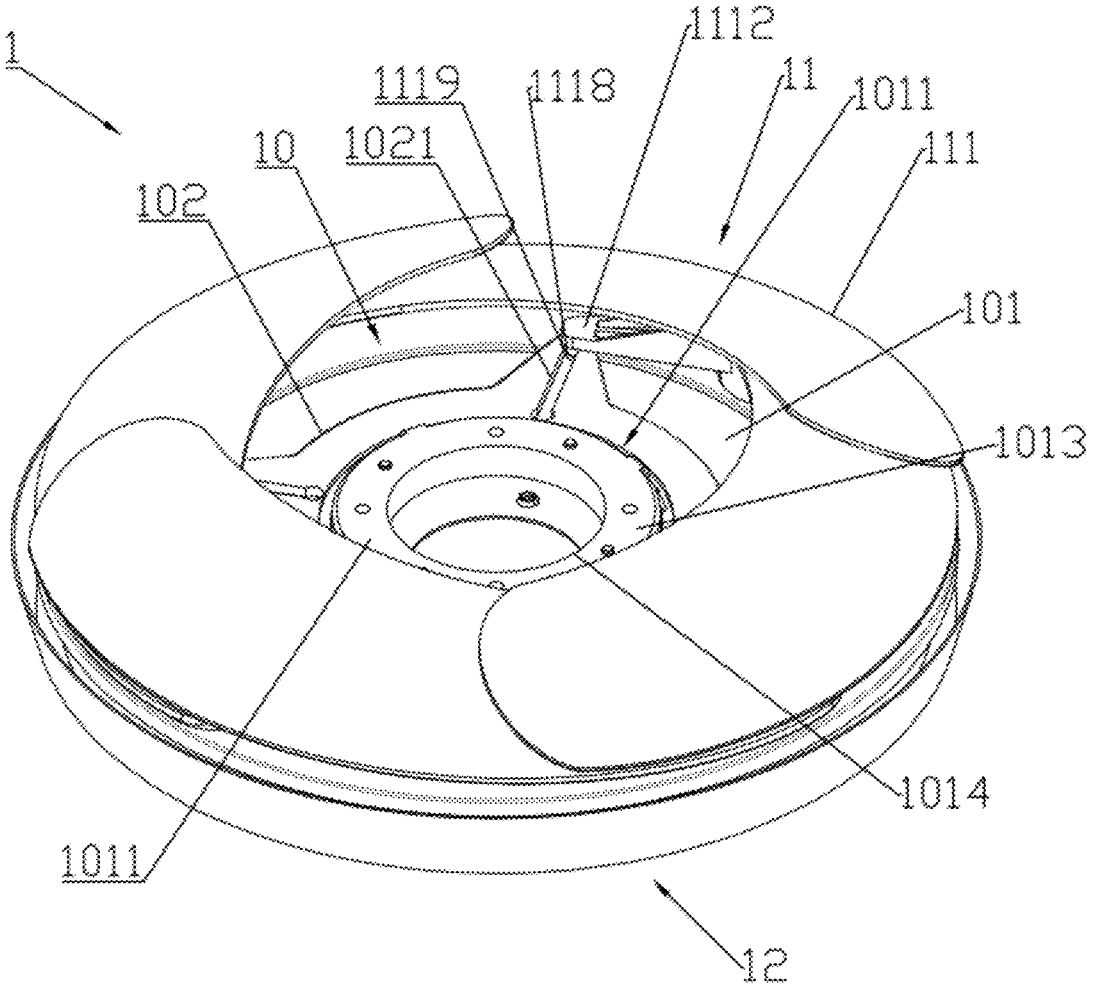
FIG. 1 is a stereoscopic assembling diagram of a hidden fan according to an example of the present disclosure.
Figure 2:
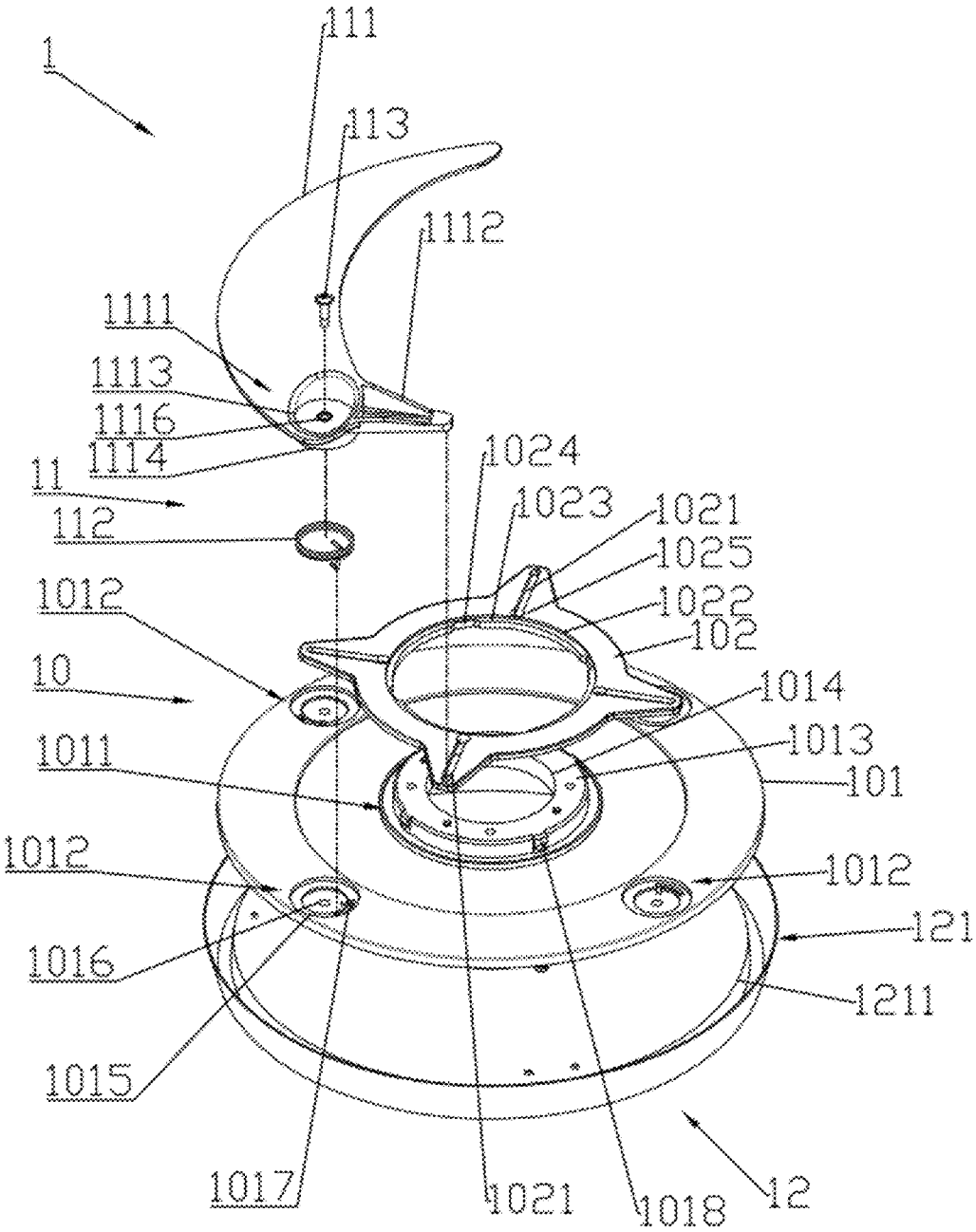
FIG. 2 is a stereoscopic exploded view of the hidden fan according to an example of the present disclosure.
Figure 3:
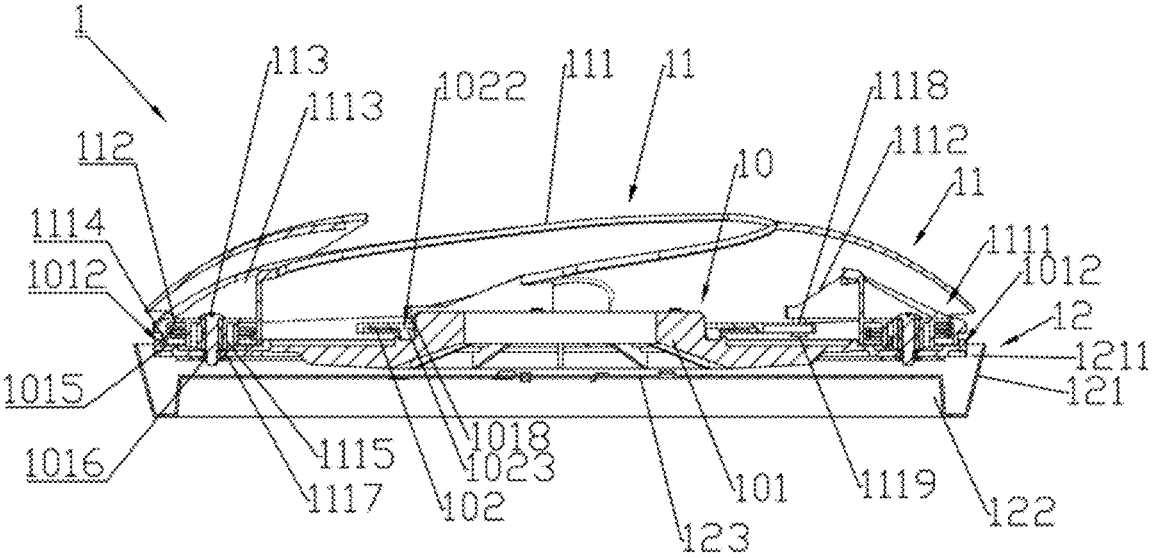
FIG. 3 is a section view of the hidden fan according to an example of the present disclosure.

Please referring to FIG. 1, FIG. 2 and FIG. 3, which are respectively a stereoscopic assembling diagram, a stereoscopic exploded view and a section view of a hidden fan according to a first example of the present disclosure. As shown in the drawings, the present example provides a hidden fan 1 which includes a turntable assembly 10 and a plurality of fan blade assemblies 11. The plurality of fan blade assemblies 11 are respectively pivoted to the turntable assembly 10. When the turntable assembly 10 rotates, the fan blade assemblies 11 are driven to unfold. The turntable assembly 10 has a turntable 101 and a limit wheel 102. The limit wheel 102 is pivoted to the turntable 101 and rotates relative to the turntable 101. The turntable 101 has a drive portion 1011 and a plurality of fan blade fixing portions 1012. The drive portion 1011 is located at the center of the turntable 101 and used to connect a drive source. The drive source is connected with the drive portion 1011 so as to drive the turntable 101 to rotate. The drive portion 1011 of the present example is a connection bump 1013 protruding from the center of the turntable 101. The connection bump 1013 has a mounting penetrating groove 1014. The plurality of fan blade fixing portions 1012 are annularly arranged around the center of the drive portion 1011 of the turntable 101. The plurality of fan blade fixing portions 1012 are equally spaced apart from each other.

The limit wheel 102 is sleeved on the connection bump 1013 of the drive portion 1011 and can rotate relative to the drive portion 1011. The limit wheel 102 has a plurality of limit grooves 1021. The plurality of limit grooves 1021 are annularly arranged around the center of the drive portion 1011 of the turntable 101 and surround a peripheral edge of the drive portion 1011. Each limit groove 1021 is a linear groove. An extension direction of each limit groove passes through the center of the drive portion 1011 of the turntable 101. The plurality of limit grooves 1021 are equally spaced apart from each other. The plurality of limit grooves 1021 respectively correspond to the plurality of fan blade fixing portions 1012. The number of the fan blade fixing portions 1012 is the same as that of the limit grooves 1021. In the present example, each fan blade fixing portion 1012 is located at a side of the corresponding limit groove 1021. The fan blade fixing portions 1012 of the present example are fixing grooves 1015, a fixing hole 1016 is at the center of the fixing groove 1015, and a bottom edge of the fixing groove has an arc fixing groove 1017.

A mounting opening 1022 is at the center of the limit wheel 102, a side wall of the mounting opening 1022 has a limit flange 1023, and the limit flange 1023 has a plurality of notches 1024. A side surface of the connection bump 1013 of the drive portion 1011 has a plurality of positioning blocks 1018 that are equally spaced apart from each other. A space is between each positioning block 1018 and the surface, with the drive portion 1011, of the turntable 101. The space is greater than or equal to a thickness of the limit flange 1023. When the limit wheel 102 is sleeved on the drive portion 1011, the mounting opening 1022 of the limit wheel 102 is sleeved on the connection bump 1013 of the drive portion 1011, and in this case, the plurality of notches 1024 of the limit flange 1023 of the limit wheel 102 correspond to the plurality of positioning blocks 1018 of the connection bump 1013, so that the limit flange 1023 of the limit wheel 102 can successfully penetrate through an end, with the plurality of positioning blocks 1018, of the connection bump 1013. After the limit flange 1023 of the limit wheel 102 enters the space between the positioning blocks 1018 and the surface, with the drive portion 1011, of the turntable 101, the limit wheel 102 rotates by an angle to enable the limit flange 1023 to correspond to the positioning blocks 1018, so as to prevent the limit wheel 102 from separating from the drive portion 1011.

A material of the turntable assembly 10 of the present example is plastic cement. The number of the parts of the turntable assembly of the present example is reduced to two, so that not only is the number of the parts of the turntable assembly 10 of the existing hidden fan reduced, and is the convenience in assembling increased, but also the rotating resistance of the turntable assembly 10 of the present example during the operation is smaller than the rotating resistance of the turntable assembly of the existing hidden fan and relatively decreases by 30%.

The plurality of fan blade assemblies 11 are respectively arranged at the fan blade fixing portions 1012. Each fan blade assembly 11 includes a fan blade 111, a return elastic component 112 and a fixed component 113. The return elastic component 112 may be, for example, a spring or another type of flexible elastic object. An end of the fan blade 111 has a fixed portion 1111 and a linkage portion 1112 connected to a side of the fixed portion 1111. In the case that the fan blade 111 is arranged at the corresponding fan blade fixing portion 1012, the fixed portion 1111 of the fan blade 111 is arranged in the fixing groove 1015 of the corresponding fan blade fixing portion 1012, and the return elastic component 112 is arranged between the fixed portion 1111 and the fixing groove 1015, an end of the return elastic component 112 is fixed at the fixed portion 1111, and the other end is fixed in the arc fixing groove 1017. The return elastic component 112 of the present example uses a torsional spring. The fixed component 113 penetrates through the fixed portion 1111 and is fixed in the fixing hole 1016 of the turntable 101 so as to fix the fan blade assembly 11 on the fan blade fixing portion 1012. The linkage portion 1112 of the fan blade 111 is connected with the corresponding limit groove 1021.

The fixed portion 1111 of the ban blade 111 has a groove 1113, a first hollow fixed column 1114 and a second hollow fixed column 1115. The groove 1113 is arranged on an outer surface of the fan blade 111, and the bottom of the groove 1113 has a through hole 1116. The first hollow fixed column 1114 is arranged on an inner surface of the fan blade 111 and corresponds to the groove 1113. The second hollow fixed column 1115 is arranged on the inner surface of the fan blade 111 and located in the first hollow fixed column 1114. A central axe of the first hollow fixed column 1114 and a central axe of the second hollow fixed column 1115 penetrate through the center of the through hole 1116. An outer diameter of a cross section of the first hollow fixed column 1114 is smaller than a diameter of the fixing groove 1015, and an inner diameter of the cross section of the first hollow fixed column 1114 is greater than an outer diameter of the return elastic component 112. An outer diameter of the cross section of the second hollow fixed column 1115 is smaller than the inner diameter of the return elastic component 112. In the case that the fixed portion 1111 is arranged in the fixing groove 1015, the return elastic component 112 is located between the first hollow fixed column 1114 and the second hollow fixed column 1115, and an end of the return elastic component 112 is fixed at the second hollow fixed column 1115. The fixed component 113 passes through the through hole 1116 of the groove 1113 and the second hollow fixed column 1115 so as to fix the fan blade 111 on the turntable 101. An inner side wall of the second hollow fixed column 1115 of the present example is additionally provided with a bearing 1117. The bearing 1117 is integral with the fan blade 111 by insert molding. The inner surface of the bearing 1117 has a tooth portion to improve the connection property with the second hollow fixed column 1115 of the fan blade 111. When the fixed component 113 fixes the fixed portion 1111 of the fan blade 111 onto the turntable 101, the fixed component 113 passes through the through hole 1116 of the groove 1113 and the bearing 1117. The bearing 1117 can reduce the friction between the fixed component 113 and the fixed portion 1111 of the fan blade 111 when the fan blade 111 rotates, so that the fan blade 111 can rotate smoothly.

In the present example, the linkage portion 1112 has a linkage column 1118. The linkage column 1118 is arranged in the limit groove 1021, so that the linkage portion 1112 is connected with the corresponding limit groove 1021. In the present example, an end, which is arranged in the limit groove 1021, of the linkage column 1118 has a positioning convex portion 1119. A diameter of the positioning convex part 1119 is greater than a width of the limit groove 1021. When the linkage column 1118 is arranged in the limit groove 1021, the positioning convex portion 1119 passes through the limit groove 1021 and abuts the bottom surface of the limit groove 1021 so as to prevent the linkage column 1118 from separating from the limit groove 1021. When the linkage column 1118 in the present example works, the linkage column 1118 is located at an end, away from the drive portion 1011, of the limit groove 1021, an end, close to the drive portion 1011, of the limit groove 1021 in the present example has a mounting hole 1025, and an aperture of the mounting hole 1025 is greater than or equal to the diameter of the positioning convex portion 1119. When the linkage column 1118 is to be arranged in the limit groove 1021, the positioning convex portion 1119 enters from the mounting hole 1022, the linkage column 1118 moves from an end, close to the drive portion 1011, of the limit groove 1021 to an end, away from the drive portion 1011, of the limit groove 1021 along the limit groove 1021 so as to complete the assembling of the linkage column 1118.

The surface of the fan blade 111 in the present example is an arc surface. A surface of an end, with the fixed portion 1111, of the fan blade 111 is lower than a surface of an end, opposite to the fixed portion 1111, of the fan blade 111. The surface of an end may be, for example, a top surface or bottom surface of the blade. When the hidden fan 1 folds, the surface of the end, opposite to the fixed portion 1111, of the fan blade 111 is superimposed on the end of the surface, with the fixed portion 1111, of the adjacent fan blade 111. When the hidden fan 1 folds, the limit groove 1021 is located at a right side of the fixed portion 1111 of the fan blade 111. When the hidden fan 1 in the present example works, the drive portion 1011 of the turntable 101 is driven by the drive source, and the drive portion 1011 drives the turntable 101 to rotate clockwise.

The number of the parts of the fan blade assembly 11 in the present example is less than that of the parts of the fan blade assembly of the existing hidden fan, so that the assembling is easy, and the assembling precision is greatly improved.

Figure 4:
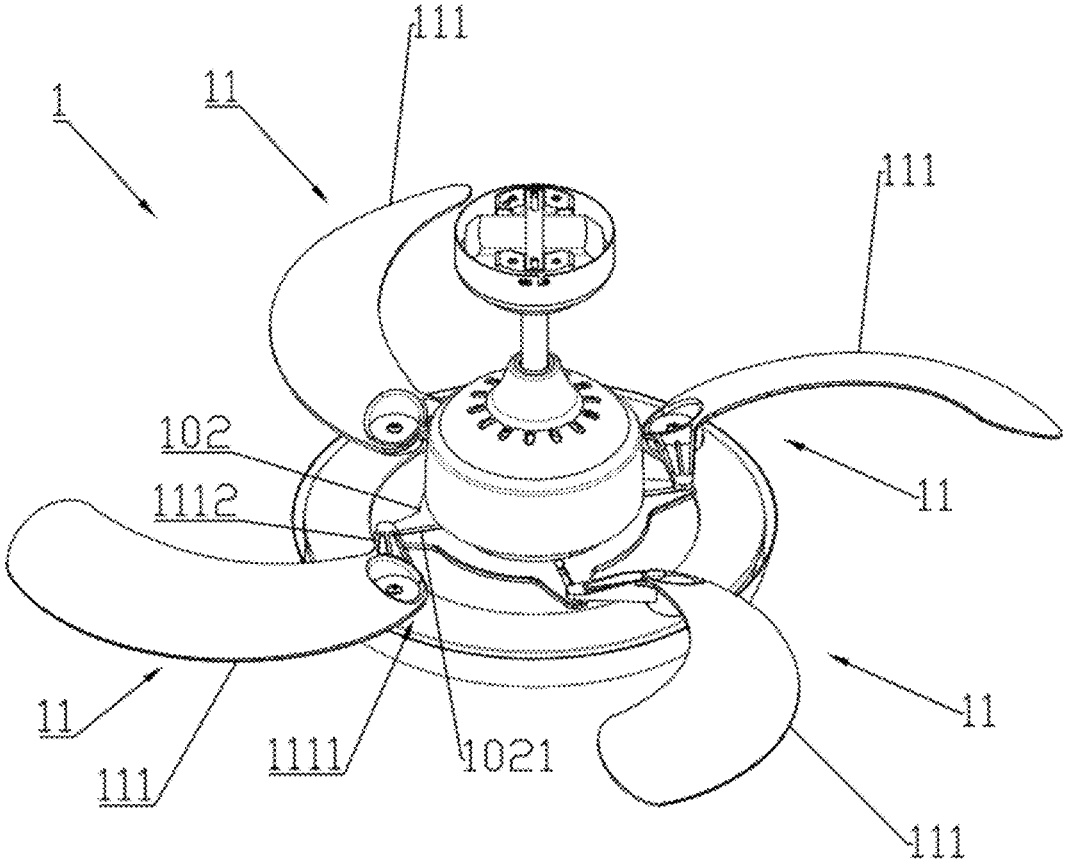
FIG. 4 is a use state diagram of the hidden fan according to an example of the present disclosure.

Please referring to FIG. 4, which is a use state diagram of the hidden fan according to the first example of the present disclosure. As shown in the drawing, along with the clockwise rotation of the turntable 101, the folded fan blades 111 unfold outwards under the action of a centrifuging force, in this case, the linkage portions 1112 of the fan blades 111 are respectively connected with the corresponding limit grooves 1021 to drive the limit wheel 102 to rotate clockwise. The linkage portions 1112 of the fan blades 111 drive the corresponding limit grooves 1021 to move to a left side of the fixed portion 1111 of the fan blade 111. When the fan blades 111 unfold outwards, the fan blades 111 stretch the return elastic components 112. When the drive source stops driving the drive portion 1011 of the turntable 101, the stretched return elastic components 112 generate a return force to automatically pull the fan blades 111 to fold inwards. At the same time, the linkage portions 1112 of the fan blades 111 drive the limit grooves 1021 to rotate, and the linkage portions 1112 of the fan blades 111 drive the corresponding limit grooves 1021 to move to the right side of the fixed portion 1111 of the fan blade 111, i.e. a position before the rotation of the limit wheel 102.

Referring to FIG. 2 and FIG. 3, the hidden fan 1 of the present example further includes a fan disc 12. The turntable assembly 10 is arranged on the fan disc 12. The fan disc 12 has a turntable connection portion 121, a lamp connection portion 122 opposite to the turntable connection portion 121 and a circuit hole 123 communicating the turntable connection portion and the lamp connection portion 122. The turntable 101 is arranged on the turntable connection portion 121. The turntable connection portion 121 of the present example has a connection groove 1211. The turntable 101 is arranged in the connection groove 1211. The lamp connection portion 122 is configured to connect a lamp. A circuit of the lamp extends out through the circuit hole 123. The fan disc 12 of the present example integrates the fan disc and a lamp disc of the existing hidden fan, thereby achieving an effect of convenience in assembling and high reliability.

Figure 5:
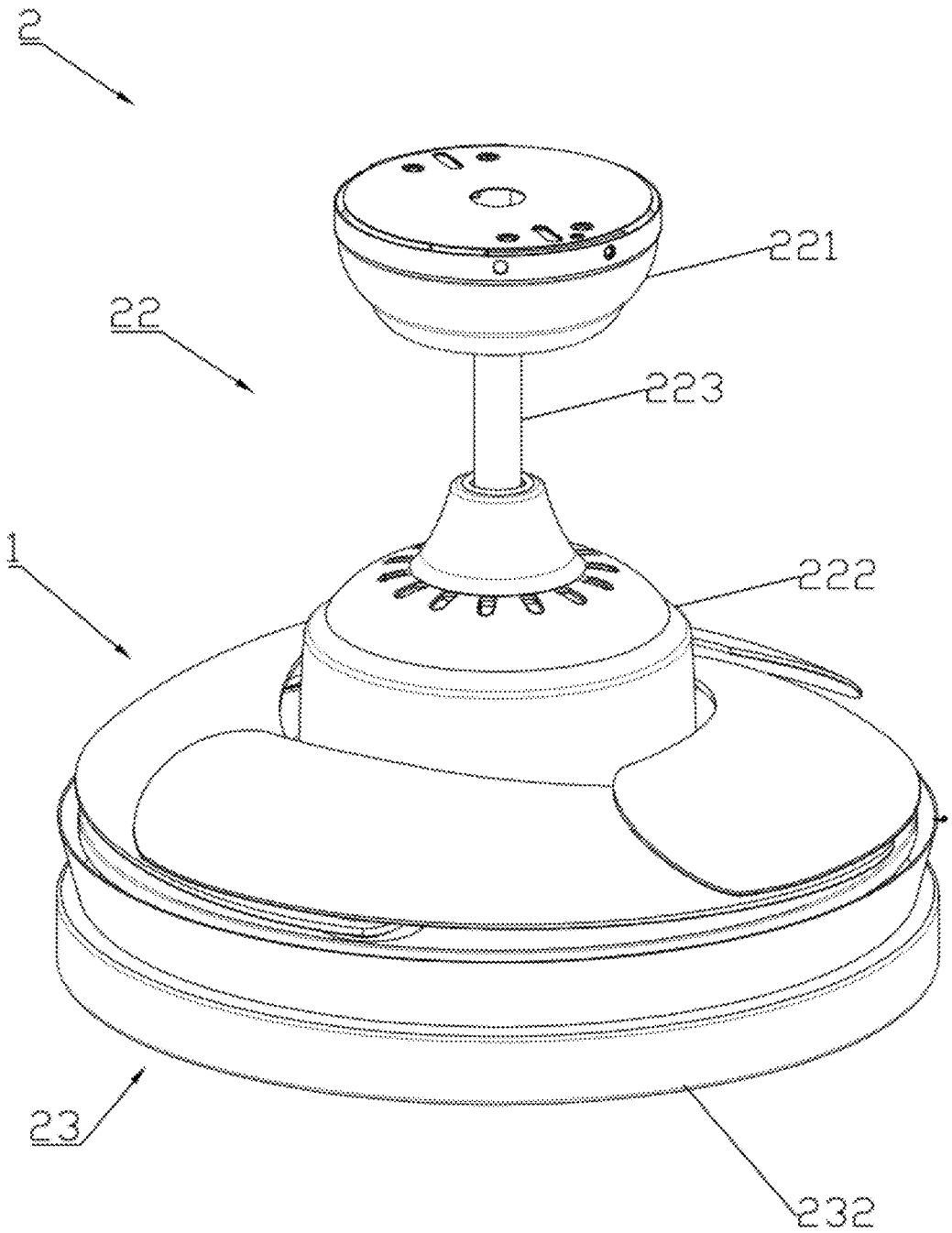
FIG. 5 is a stereoscopic diagram of a fan lamp according to an example of the present disclosure.
Figure 6:
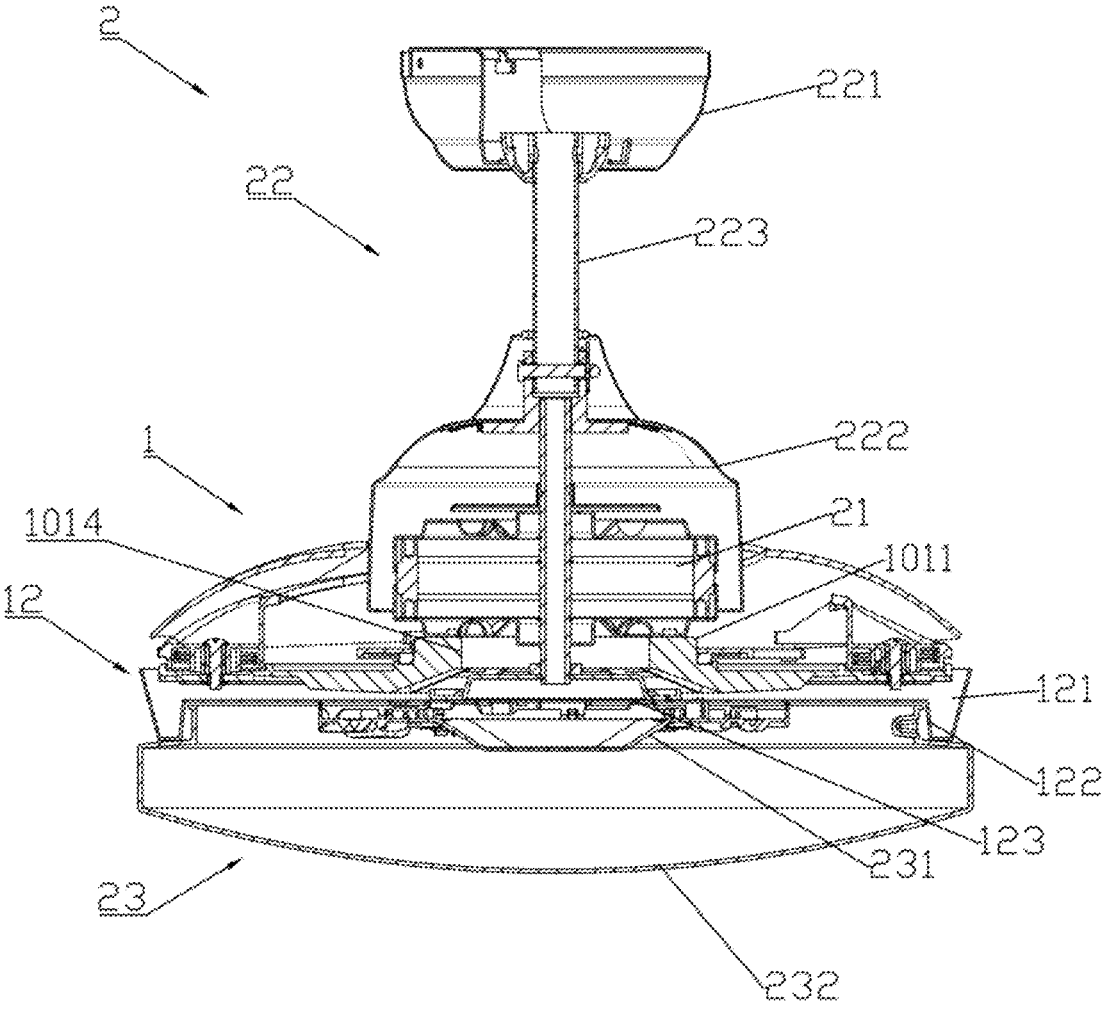
FIG. 6 is a section view of the fan lamp according to an example of the present disclosure.

Please refer to FIG. 5 and FIG. 6, which are a stereoscopic diagram and a section view of a fan lamp according to a second example of the present disclosure. As shown in the drawings, the present example provides a fan lamp 2. The fan lamp 2 includes a hidden fan 1, a drive motor 21, a mounting assembly 22 and a lamp 23. The drive motor 21 is arranged at the drive portion 1011 and connected with the turntable connection portion 121 of the fan disc 12 through the mounting groove 1014 to drive the hidden fan 1 to rotate. An end of the mounting assembly 22 is covered on the drive motor 21, and an end is fixed on a wall or a ceiling to fix the hidden fan 1 on the wall or the ceiling. The lamp 22 is arranged at the lamp connection portion 122 of the hidden fan 1 and is opposite to the hidden fan 1. In the present example, the mounting assembly 22 includes a mounting seat 221, a protection cover 222 and a connection rod 223. The connection rod 223 is connected to the mounting seat 221 and the protection cover 222. The protection cover 222 is covered on the drive motor 21. The mounting seat 221 is fixed on the wall or the ceiling. The lamp 23 includes a light source module 231 and a lamp house 232. The light source module 231 is mounted in the lamp connection portion 122. The lamp house 232 is arranged at the lamp connection portion 122 and is covered on the light source module 231. The connection rod 223 of the present example is a hollow rod body. The mounting seat 221 is also a hollow seat body. A lamp actuator can be arranged in the mounting seat 221, or the light source module 231 has the lamp actuator. The lamp actuator of the present example is arranged on the light source module 231. A circuit of the light source module 231 extends out through the circuit hole 123 and penetrates through the drive motor 21 and penetrates through the connection rod 223 and the mounting seat 221 together with a circuit of the drive motor 21 so as to be connected with the city electricity. If the lamp actuator is arranged at the mounting seat 221, the circuit of the light source module 231 extends out through the circuit hole 123 and penetrates through the drive motor 21 to be connected with the lamp actuator, and then the lamp actuator is connected with the city electricity.

In conclusion, the present disclosure provides the hidden fan and the fan lamp. By reducing the number of the parts of each assembly, the number of the parts of the hidden fan is less than the number of the parts of the existing hidden fan, so that the structure of the hidden fan is simplified, and the load on the turntable assembly of the hidden fan is reduced, thereby achieving a purpose of increasing the energy efficiency and decreasing the cost. Furthermore, the assembling is convenient and the assembling precision is increased.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

It should be noted that terms in the present disclosure such as "include", "contain" or any other variations thereof are intended to cover a non-exclusive inclusion, so that a process, a method, an article, or an apparatus including a series of components does not include only those components but also other components not expressly listed, or also includes the intrinsic components of the process, the method, the article, or the apparatus. Without further limitations, an element defined by the sentence "including an" do not exclude the presence of other same components in the process, the method, the article the or apparatus including the component.

The examples of the present disclosure are described above in combination with the accompanying drawings, but the present disclosure is not limited to the above specific examples. The above examples are only illustrative and not restrictive. Various forms could be made by those ordinary skilled in the art without departing from the purpose of the present disclosure and the protection scope claimed by the claims under the inspiration of the present disclosure should fall within the protection scope of the present disclosure.

What is claimed is:

1. A hidden fan, comprising:

a turntable assembly; and a plurality of fan blade assemblies arranged at the turntable assembly, wherein the turntable assembly has a turntable and a limit wheel configured to rotate relative to the turntable, the turntable has a plurality of fan blade fixing portions, and the plurality of fan blade fixing portions are annularly arranged around a center of the turntable, wherein at least one of the plurality of fan blade assemblies has a fan blade and a return elastic component, the fan blade has a fixed portion and a linkage portion arranged at a side of the fixed portion, the fixed portion is arranged at a corresponding fan blade fixing portion, the linkage portion is connected with the limit wheel, the return elastic component is arranged between the fixed portion and the fan blade fixing portion, and two ends of the return elastic component are respectively connected with the fixed portion and a respective fan blade fixing portion.

2. The hidden fan according to claim 1, wherein a drive portion is at the center of the turntable, and the drive portion is connected with a drive source.

3. The hidden fan according to claim 2, wherein the drive portion comprises a connection bump with a mounting penetrating groove, and the connection bump protrudes from a surface, with the plurality of fan blade fixing portions, of the turntable.

4. The hidden fan according to claim 2, wherein the limit wheel is sleeved on the drive portion, the limit wheel has a plurality of limit grooves, the plurality of limit grooves are annularly arranged around a center of the drive portion, the plurality of limit grooves respectively correspond to the plurality of fan blade fixing portions, and the linkage portion of each of the fan blade fixing portions is connected with the corresponding limit groove.

5. The hidden fan according to claim 4, wherein a mounting opening is at a center of the limit wheel, a side wall of the mounting opening has a limit flange, the limit flange has a plurality of notches, an outer side wall of the drive portion has a plurality of positioning blocks corresponding to the plurality of notches, and a space is between the positioning blocks and the surface, with the drive portion, of the turntable drive portion; the space is greater than or equal to a thickness of the limit bump, the drive portion penetrates through the mounting opening, the limit flange is in the space, and the limit flange corresponds the plurality of positioning blocks.

6. The hidden fan according to claim 4, wherein the linkage portion has a linkage column, and the linkage column penetrates through the limit groove.

7. The hidden fan according to claim 4, wherein the limit groove is a linear groove, and an extension direction of the limit groove passes through the center of the drive portion.

8. The hidden fan according to claim 7, wherein an end of the limit groove close to the drive portion has a mounting hole, an end of the linkage column is provided with a positioning convex portion, a diameter of the positioning convex portion is greater than a width of the limit groove, and an aperture of the mounting hole is greater than or equal to a diameter of the positioning convex portion.

9. The hidden fan according to claim 1, wherein the fan blade fixing portion comprises a fixing groove, a fixing hole is at a center of the fixing groove, and a bottom edge of the fixing groove has an arc fixing groove, the fixed portion of the fan blade is arranged in the fixing groove, an end of the return elastic component is arranged in the arc fixing groove, and a fixed component penetrates through the fixed portion and is fixed in the fixing hole.

10. The hidden fan according to claim 9, wherein the fixed portion of the fan blade has a groove, a first hollow fixed column, and a second hollow fixed column; the groove is arranged on an outer surface of the fan blade, and a bottom of the groove has a through hole; the first hollow fixed column and the second hollow fixed column are arranged on an inner surface of the fan blade, and the second hollow fixed column is arranged in the first hollow fixed column; a central axe of the first hollow fixed column and a central axe of the second hollow fixed column pass through a center of the through hole; the first hollow fixed column is arranged in the fixing groove; the fixed component passes through the through hole and the second hollow fixed column; and the return elastic component is arranged between the first hollow fixed column and the second hollow fixed column, and an end of the return elastic component is fixed at the second hollow fixed column.

11. The hidden fan according to claim 10, wherein an inner side wall of the second hollow fixed column further has a bearing, and the fixed component penetrates through the bearing.

12. The hidden fan according to claim 1, wherein a surface of an end, with the fixed portion, of the fan blade is lower than a surface of an end, opposite to the fixed portion, of the fan blade, and in a case where the plurality of fan blade assemblies fold, the end, opposite to the fixed portion, of the fan blade is superimposed onto the end, with the fixed portion, of an adjacent fan blade.

13. The hidden fan according to claim 1, wherein the hidden fan further comprises a fan disc, and the turntable assembly is arranged on the fan disc.

14. The hidden fan according to claim 13, wherein the fan disc has a turntable connection portion, a lamp connection portion opposite to the turntable connection portion, and a circuit hole communicating the turntable connection portion and the lamp connection portion, and the turntable assembly is arranged on the turntable connection portion.

15. A fan lamp, comprising:

a hidden fan, comprising:

a turntable assembly; and a plurality of fan blade assemblies arranged at the turntable assembly, wherein the turntable assembly has a turntable and a limit wheel configured to rotate relative to the turntable, the turntable has a plurality of fan blade fixing portions, and the plurality of fan blade fixing portions are annularly arranged around a center of the turntable, wherein each of the plurality of fan blade assemblies has a fan blade and a return elastic component, the fan blade has a fixed portion and a linkage portion arranged at a side of the fixed portion, the fixed portion is arranged at a corresponding fan blade fixing portion, the linkage portion is connected with the limit wheel, the return elastic component is arranged between the fixed portion and the fan blade fixing portion, and two ends of the return elastic component are respectively connected with the fixed portion and a respective fan blade fixing portion, wherein the hidden fan further comprises a fan disc, and the turntable assembly is arranged on the fan disc, wherein the fan lamp comprises a drive motor, a mounting assembly, and a lamp, the drive motor is connected with the fan disc and the turntable, an end of the mounting assembly is covered on the drive motor, and the lamp is arranged on the fan disc and is opposite to the hidden fan.

16. The fan lamp according to claim 15, wherein the mounting assembly comprises a mounting seat, a protection cover, and a connection rod connecting the mounting seat and the protection cover, and the protection is covered on the drive motor.

17. The fan lamp according to claim 16, wherein a circuit of the lamp penetrates through the fan disc, the drive motor, the connection rod and the mounting seat to be connected with city electricity.

18. The fan lamp according to claim 16, wherein a circuit of the drive motor penetrates through the connection rod and the mounting seat to be connected with city electricity.

* * * * *